US008163687B2

(12) United States Patent
Riou et al.

(10) Patent No.: US 8,163,687 B2
(45) Date of Patent: Apr. 24, 2012

(54) LIQUID HARD SURFACES CLEANING COMPOSITIONS

(75) Inventors: Fabienne Riou, St. Martin des Champs (FR); Marina Jozefa Hermie, Hever (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/985,213

(22) Filed: Nov. 14, 2007

(65) Prior Publication Data

US 2008/0255018 A1 Oct. 16, 2008

(30) Foreign Application Priority Data

Nov. 14, 2006 (EP) ..... 06124062

(51) Int. Cl.

| | |
|---|---|
| ***C11D 1/75*** | (2006.01) |
| ***C11D 1/66*** | (2006.01) |
| ***C11D 3/26*** | (2006.01) |
| ***C11D 3/43*** | (2006.01) |

(52) U.S. Cl. ..... 510/238; 510/239; 510/423; 510/433; 510/434; 510/475; 510/477; 510/488; 510/503; 510/504

(58) Field of Classification Search ..... 510/238, 510/239, 423, 433, 434, 475, 477, 488, 503, 510/504

See application file for complete search history.

(56) References Cited

U.S. PATENT DOCUMENTS

| | | | | |
|---|---|---|---|---|
| 4,587,030 | A | 5/1986 | Casey | |
| 6,251,849 | B1 | 6/2001 | Jeschke et al. | |
| 6,569,261 | B1 * | 5/2003 | Aubay et al. | 134/39 |

FOREIGN PATENT DOCUMENTS

| | | | |
|---|---|---|---|
| EP | 0 017 149 | A1 | 10/1980 |
| EP | 0 342 997 | A2 | 11/1989 |
| EP | 0 875 552 | A1 | 11/1998 |
| EP | 0 957 156 | B1 | 11/1999 |
| EP | 1 362 907 | A2 | 11/2003 |
| GB | 2 340 501 | A | 2/2000 |
| WO | WO 99/60085 | A1 | 11/1999 |
| WO | WO 01/31110 | A1 | 5/2001 |
| WO | WO 2005/100523 | A | 10/2005 |

OTHER PUBLICATIONS

PCT International Search Report dated Apr. 4, 2008—4 Pages.

* cited by examiner

*Primary Examiner* — Gregory R Del Cotto
(74) *Attorney, Agent, or Firm* — John T. Dipre; Amy I. Ahn-Roll

(57) ABSTRACT

The present invention relates to a liquid composition, having a pH between 3 and 7, comprising a non ionic surfactant or a mixture thereof, an amine oxide or a mixture thereof, a glycol ether solvent, a chelant and a cationic polymer. The composition of the present invention does not contain any anionic surfactant. The present invention also encompasses a process of treating hard-surfaces, including delicate hard-surfaces located in bathrooms, wherein a liquid composition according to the present invention is applied onto said surfaces.

16 Claims, No Drawings

LIQUID HARD SURFACES CLEANING COMPOSITIONS

TECHNICAL FIELD

The present invention relates to liquid compositions for cleaning hard-surfaces.

BACKGROUND OF THE INVENTION

Liquid compositions for cleaning hard-surfaces have been disclosed in the prior art. Much of the focus for such compositions has been to provide outstanding cleaning benefits on a variety of surfaces and to provide improved performance on a variety of soils such as the removal of limescale and other depositions such as greasy soap scum.

EP 0 957 156 B1 discloses a liquid acidic surface cleaning composition comprising an anionic surfactant, a polysaccharide polymer and a homo copolymer of vinylpyrrolidone, or a mixture thereof.

WO 01/31110 A1 discloses a aqueous hard surface cleaning composition, efficient for removing greasy soap scum, for bathroom comprising surfactants, organic solvent, tetrapotassium ethylendiamine tetraacetate and an abrasive.

WO 09/960,085 discloses a liquid surface cleaner rinse for rinsing greasy soap scum comprising amphoteric surfactants, a chelating agent, a solvent, a builder and a base or an acid.

It is well-known in the art that limescale deposits can be chemically removed with acidic solutions. However, liquid acidic compositions described in the art are not fully satisfactory from a consumer viewpoint especially regarding the greasy soap scum removal properties. Moreover, there are limitations to the convenience and usefulness of acidic compositions commonly used as hard surface cleaner. Indeed, it is know that some surfaces are sensitive to acids and may be severely damaged by acidic compositions. Such surfaces are defined herein as delicate surfaces. Delicate surfaces are for example linoleum, plastic, plastified wood, metal, enamel or varnished surfaces. Particularly delicate surfaces are plastic surfaces. Plastic surfaces are surfaces commonly used in bathroom and toilet in certain countries, especially Asiatic countries.

Thus, there is a constant need for the development of cleaning compositions with better cleaning performance on delicate surface, including improved soap scum cleaning performance and excellent limescale removal performance, without damaging delicate surface such as plastic surfaces.

Therefore, the present invention relates to compositions well adapted to treat delicate surfaces wherein the compositions have improved soap scum cleaning performance while delivering also excellent limescale removal performance.

It has now been surprisingly found that the problems of past acidic compositions may be met in part by providing a liquid composition comprising: a nonionic surfactant or a mixture thereof, an amine oxide or a mixture thereof, a glycol ether solvent, a chelant and a cationic polymer. A feature of this composition is that this composition does not contain any anionic surfactant. Another feature of this composition is that this composition has a pH between 3 and 7.

The composition described herein may provide improved soap scum removal performances when applied on hard-surfaces without damaging the treated surface, especially delicate surfaces. Indeed, the composition is safe to said surfaces while exhibiting a good cleaning performance on a variety of soils. The composition is safe for the person who uses it, i.e. said composition is not too aggressive toward the human skin.

The composition may provide outstanding greasy soap scum performance and soil repellency properties when the composition is applied to hard surface, meaning that the composition will prevent or at least reduce the deposition of soil after an initial cleaning operation. Moreover, the composition may exhibit good filming and/or streaking performance and good shine performance; which means herein that the above composition may provide a surface which is clean and which has a shiny appearance without showing any visible filming and/or streaking.

A further advantage of the present invention is that the liquid compositions may show good stain/soil removal performance on various types of stains/soils in particular: greasy soils, e.g., greasy soap scum or greasy soils found in kitchens; limescale; mold; mildew; and other tough stains found on surfaces. More particularly, increased removal performance upon contact of the liquid composition may be obtained on greasy stains, as well as on particulate greasy stains and greasy soap scum, without applying mechanical action.

The composition of the present invention may be used on various delicate hard surfaces such as plastic and enamel. Enamel and plastic surfaces can be found in various places, e.g., in households: in kitchens (sinks and the like); in bathrooms (tubs, sinks, shower tiles, bathroom enamelware and the like) . . . . The composition of the present invention may also be used to clean hard surfaces made of a variety of materials like glazed and non-glazed ceramic tiles, stainless steel, Inox®, Formica®, vinyl, no-wax vinyl, linoleum, melamine, all plastics and plastified wood.

The present invention provides a process for cleaning hard surfaces, more specifically delicate hard surfaces, with the composition of the present invention. The process of the present invention provides outstanding greasy soap scum and limescale performance and also soil repellency properties when the composition is applied to hard surface, meaning that the composition will prevent or at least reduce the deposition of soil after an initial cleaning operation. In one embodiment of the present invention, the composition is packaged in a spray-type container, preferably a mechanical trigger spray-type dispenser. The composition of the present invention will thus be applied onto a hard surface in the form of a spray.

SUMMARY OF THE INVENTION

The present invention relates a liquid composition, having a pH between 3 and 7, comprising:

a) a non ionic surfactant or a mixture thereof,
b) an amine oxide or a mixture thereof,
c) a glycol ether solvent,
d) a chelant,
e) a cationic polymer.

An essential feature of this composition is that the composition of the present invention does not contain any anionic surfactant. The present invention also encompasses a process of treating hard-surfaces, alternatively delicate hard-surfaces located in bathrooms, wherein a liquid composition according to the present invention is applied onto said surfaces.

DETAILED DESCRIPTION OF THE INVENTION

The Liquid Hard-Surface Cleaning Composition

The compositions according to the present invention are designed as hard-surfaces cleaners, including those located in bathrooms. The present invention has the advantage of being safe on delicate surfaces.

By "safe to delicate surfaces" it is meant herein that the compositions as described herein prevent or at least reduce damage to delicate surfaces treated therewith as compared to highly acidic compositions.

By "Delicate surfaces" it is meant herein surfaces which are sensitive to acids and which may be severely damaged by hard surface cleaning composition, especially by highly acidic hard surface compositions. Delicate surfaces can be, for example linoleum, plastic, plastified wood, metal, enamel or varnished surfaces. Delicate surface will refer herein to plastic surfaces.

The liquid compositions according to the present invention are aqueous compositions. Therefore, they typically comprise from 70% to 99% by weight of the total composition of water, preferably from 75% to 95% and more preferably from 85% to 95%. The liquid compositions of the present invention are acidic or neutral. The composition of the present invention has a specific pH. The compositions described herein have a from 3 to 7, alternatively from 3.5 to 6.5.

Thus, the composition of the present invention may comprise an acid or a mixture thereof. Typically, the acids used herein may be any organic or inorganic acid well-known to those skilled in the art, or a mixture thereof. The organic acids for use herein may have a pK of less than 7. Suitable organic acids for use herein, are those selected from the group consisting of citric acid, maleic acid, lactic acid, glycolic acid, succinic acid, glutaric acid and adipic acid, and mixtures thereof. A mixture of said acids suitable for use herein is commercially available from BASF under the trade name Sokalan® DCS. One acid for use herein is citric acid. The inorganic acids for use herein have a pK of less than 3. Suitable inorganic acids for use herein, are those selected from the group consisting of sulphuric acid, chloridric acid, phosphoric acid, nitric acid, and mixtures thereof. The amount of acid herein may vary depending on the amount of other ingredients, but suitable amounts of acids herein generally comprised between 0.5% and 10% by weight of the total composition, alternatively between 1% and 8%, and alternatively between 2% and 6% particularly when citric acid is used.

Nonionic Surfactant

The compositions of the present invention may comprise, a nonionic surfactant, or a mixture thereof.

Such classes of surfactants may contribute to the cleaning performance of the hard-surface compositions. It has been found in particular that nonionic surfactants may strongly contribute in achieving highly improved performance on greasy soap scum removal.

The compositions according to the present invention may comprise up to 15% by weight of the total composition of a nonionic surfactant or a mixture thereof, alternatively from 0.1% to 15%, alternatively from 1% to 10%, even more preferably from 1% to 5%, and most preferably from 1% to 3%.

Suitable nonionic surfactants for use herein are alkoxylated alcohol nonionic surfactants which can be readily made by condensation processes which are well-known in the art. However, a great variety of such alkoxylated alcohols, especially ethoxylated and/or propoxylated alcohols is also conveniently commercially available. Surfactants catalogs are available which list a number of surfactants, including nonionics. Accordingly, alkoxylated alcohols for use herein are nonionic surfactants according to the formula RO(E)e(P)pH where R is a hydrocarbon chain of from 2 to 24 carbon atoms, E is ethylene oxide and P is propylene oxide, and e and p which represent the average degree of, respectively ethoxylation and propoxylation, are of from 0 to 24. The hydrophobic moiety of the nonionic compound can be a primary or secondary, straight or branched alcohol having from 8 to 24 carbon atoms. Nonionic surfactants for use in the compositions according to the invention are the condensation products of ethylene oxide with alcohols having a straight alkyl chain, having from 6 to 22 carbon atoms, wherein the degree of ethoxylation is from 1 to 15, preferably from 5 to 12. Such suitable nonionic surfactants are commercially available from Shell, for instance, under the trade name Dobanol® or from BASF under the trade name Lutensol®.

Amine Oxide

The compositions of the present invention may comprise an Amine Oxide.

Amine Oxide can be incorporated in the compositions herein in amounts ranging from 0.001% to 10% by weight of the total composition, preferably 0.01% to 5%, alternatively 0.05% to 3%.

Suitable amine oxides are the amine oxide corresponding to the formula:

$$RR'R''N \rightarrow O$$

wherein R is a primary alkyl group containing 6-24 carbons, alternatively 10-18 carbons and even alternatively 12-14 carbons, and wherein R' and R" are, each, independently, an alkyl group containing 1 to 6 carbon atoms. The arrow in the formula is a conventional representation of a semi-polar bond. The preferred amine oxides are those in which the primary alkyl group has a straight chain in at least most of the molecules, generally at least 70%, alternatively at least 90% of the molecules, and the amine oxides are those in which R contains 10-18 carbons and R' and R" are both methyl. Exemplary amine oxides are the N-hexyldimethylamine oxide, N-octyldimethylamine oxide, N-decyldimethylamine oxide, N-dodecyl dimethylamine oxide, N-tetradecyldimethylamine oxide, N-hexadecyl dimethylamine oxide, N-octadecyldimethylamine oxide, N-eicosyldimethylamine oxide, N-docosyldimethylamine oxide, N-tetracosyl dimethylamine oxide, the corresponding amine oxides in which one or both of the methyl groups are replaced with ethyl or 2-hydroxyethyl groups and mixtures thereof. One amine oxide for use herein is N-decyldimethylamine oxide. Suitable amine oxides for use herein are for instance coconut dimethyl amine oxides, C12-C16 dimethyl amine oxides. Said amine oxides may be commercially available from Hoechst, Stephan, AKZO (under the trade name Aromox®) or FINA (under the trade name Radiamox®). In one embodiment, the composition of the present invention has a specific ratio Amine oxide/nonionic surfactant. In another embodiment, the ratio between nonionic surfactant and amine oxide, of the composition, is comprised between 20/80 and 80/20, alternatively 40/60-60/40, alternatively the ration is 60/40.

Cationic Polymer

The compositions of the present invention may comprise a cationic polymer.

In the composition of the present invention, the cationic polymer herein is preferably present at a level of from 0.001% to 10%, alternatively from 0.005% to 1%, alternatively from 0.01% to 0.5% by weight of the composition.

Any cationic polymer, known from the person skilled in the art, may be suitable for the present invention. In one embodiment, the cationic polymer is a water-soluble or water-dispersible copolymer. In another embodiment, the cationic polymer herein is either a water-soluble or water-dispersible copolymer I as described herein below or is a water-soluble or water-dispersible copolymer II as described herein below.

The water-soluble or water-dispersible copolymer I of the present invention comprises, in the form of polymerized units:

a) at least a monomer compound of general formula i:

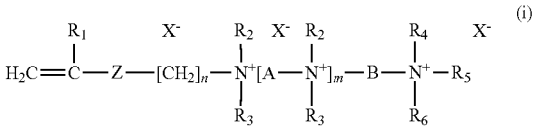

(i)

in which: $R_1$ is a hydrogen atom, a methyl or ethyl group; $R_2$, $R_3$, $R_4$, $R_5$ and $R_6$, which are identical or different, are linear or branched $C_1$-$C_6$, alkyl, hydroxyalkyl or aminoalkyl groups; m is an integer from 0 to 10; n is an integer from 1 to 6; Z represents a—C(O)O— or —C(O)NH-group or an oxygen atom; A represents a $(CH_2)_p$ group, p being an integer from 1 to 6; B represents a linear or branched $C_2$-$C_{12}$, polymethylene chain optionally interrupted by one or more heteroatoms or heterogroups, and optionally substituted by one or more hydroxyl or amino groups;

$X^-$, which are identical or different, represent counterions; and (b) at least one hydrophilic monomer carrying a functional acidic group which is copolymerizable with (a) and which is capable of being ionized in the application medium;

(c) optionally at least one monomer compound with ethylenic unsaturation with a neutral charge which is copolymerizable with (a) and (b), preferably a hydrophilic monomer compound with ethylenic unsaturation with a neutral charge, carrying one or more hydrophilic groups, which is copolymerizable with (a) and (b).

The monomer (a) can be prepared, for example, according to the reaction schemes shown in U.S. Pat. No. 6,569,261 to Rhodia, column 2, line 40 to column 3, line 45.

The resulting water-soluble or water-dispersible copolymer herein has a molecular mass of at least 1000, alternatively of at least 10,000; it can range up to 20,000,000, alternatively up to 10,000,000. Except when otherwise indicated, when the term molecular mass is used, it will refer to the weight-average molecular mass, expressed in g/mol. The latter can be determined by aqueous gel permeation chromatography (GPC) or measurement of the intrinsic viscosity in a 1N $NaNO_3$ solution at 30° C. The copolymer is preferably a random copolymer. Preferably, in the general formula (I) of the monomer (a), Z represents C(O)O, C(O)NH or O, very preferably C(O)NH; n is equal to 2 or 3, very particularly 3; m ranges from 0 to 2 and is preferably equal to 0 or 1, very particularly to 0; B represents —CH2-CH(OH)—(CH2)q, with q from 1 to 4, preferably equal to 1; $R_1$ to $R_6$, which are identical or different, represent a methyl or ethyl group.

One monomer (a) is a diquat of following formula:

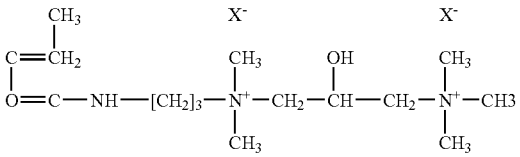

in which $X^-$ representing the chloride ion.

Other monomers (a) are:

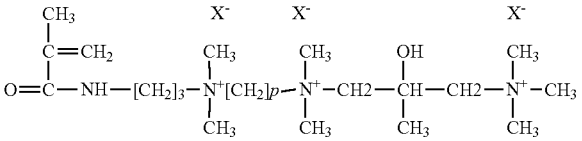

wherein p=2 to 4.

The X anions are in particular a halogen, alternatively chlorine, sulfonate, sulfate, hydrogensulfate, phosphate, phosphonate, citrate, formate and acetate anion.

The monomers (b) are advantageously $C_3$-$C_8$ carboxylic, sulphonic, sulfuric, phosphonic or phosphoric acids with monoethylenic unsaturation, their anhydrides and their salts which are soluble in water and mixture thereof. Preferred monomers (b) are acrylic acid, methacrylic acid, α-ethacrylic acid, β,β-dimethylacrylic acid, methylenemalonic acid, vinylacetic acid, allylacetic acid, ethylidineacetic acid, propylidineacetic acid, crotonic acid, maleic acid, fumaric acid, itaconic acid, citraconic acid, mesaconic acid, N-(methacroyl)alanine, N-(acryloyl)hydroxyglycine, sulfopropyl acrylate, sulfoethyl acrylate, sulfoethyl methacrylate, styrenesulfonic acid, vinylsulfonic acid, vinylphosphonic acid, phosphoethyl acrylate, phosphonoethyl acrylate, phosphopropyl acrylate, phosphonopropyl acrylate, phosphoethyl methacrylate, phosphonoethyl methacrylate, phosphopropyl methacrylate, phosphonopropyl methacrylate and the alkali metal and ammonium salts thereof and mixtures thereof.

Optional monomers (c) may include acrylamide, vinyl alcohol, $C_1$-$C_4$ alkyl esters of acrylic acid and of methacrylic acid, $C_1$-$C_4$ hydroxyalkyl esters of acrylic acid and of methacrylic acid, in particular ethylene glycol and propylene glycol acrylate and methacrylate, polyalkoxylated esters of acrylic acid and of methacrylic acid, in particular the polyethylene glycol and polypropylene glycol esters, esters of acrylic acid or of methacrylic acid and of polyethylene glycol or polypropylene glycol $C_1$-$C_{25}$ monoalkyl ethers, vinyl acetate, vinylpyrrolidone or methyl vinyl ether and mixtures thereof.

The level of monomers (a) is between 3 and 80 mol %, alternatively 10 to 70 mol %. The level of monomers (b) is between 10 and 95 mol %, alternatively 20 to 80 mol %. The level of monomers (c) is between 0 and 50%, alternatively 0 and 30%. The molar ratio of cationic monomer to the anionic monomer (a)/(b) is advantageously between 80/20 and 5/95, preferably between 60/40 and 20/80.

The water-soluble or water-dispersible copolymer I herein can be obtained according to known techniques for the preparation of copolymers, in particular by polymerization by the radical route of the starting ethylenically unsaturated monomers, which are known compounds or compounds which can be easily obtained by a person skilled in the art by employing conventional synthetic processes of organic chemistry. Reference may in particular be made to the processes disclosed in U.S. Pat. No. 4,387,017 and EP 156,646. The radical polymerization is carried out in an environment which is devoid of oxygen, for example in the presence of an inert gas (helium, argon, and the like) or of nitrogen. The reaction is carried out in an inert solvent, alternatively ethanol or methanol, and alternatively in water. The polymerization is initiated by addition of a polymerization initiator. The initiators used are the free radical initiators commonly used in the art. Examples comprise organic peresters (t-butylperoxy pivalate, t-amylperoxy pivalate, t-butylperoxy α-ethylhexanoate, and the like);

organic compounds of azo type, for example azobisamidinopropane hydrochloride, azobisisobutyronitrile, azobis(2,4-dimethylvaleronitrile), and the like); inorganic and organic peroxides, for example hydrogen peroxide, benzyl peroxide and butyl peroxide, and the like; redox initiating systems, for example those comprising oxidizing agents, such as persulfates (in particular ammonium or alkali metal persulfates, and the like); chlorates and bromates (including inorganic or organic chlorates and/or bromates); reducing agents, such as sulfites and bisulfites (including inorganic and/or organic sulfites or bisulfites); oxalic acid and ascorbic acid, as well as the mixtures of two or more of these compounds. Initiators are water-soluble initiators. Sodium persulfate and azobisamidinopropane hydrochloride are in particular preferred. In an alternative form, the polymerization can be initiated by irradiation using ultraviolet light. The amount of initiators used is generally an amount sufficient can produce initiation of the polymerization. The initiators are preferably present in an amount ranging from 0.001 to approximately 10% by weight with respect to the total weight of the monomers and are alternatively in an amount of less than 0.5% by weight with respect to the total weight of the monomers, an alternative amount being situated in the range from 0.005 to 0.5% by weight with respect to the total weight of the monomers. The initiator is added to the polymerization mixture either continuously or noncontinuously. When it is wished to obtain copolymers of high molecular mass, it is desirable to add fresh initiator during the polymerization reaction. The gradual or noncontinuous addition also makes possible a more efficient polymerization and a shorter reaction time. The polymerization is carried out under reaction conditions which are effective in polymerizing the monomers (a), the monomers (b) and optionally the monomers (c) under an atmosphere devoid of oxygen. The reaction is preferably carried out at a temperature ranging from approximately 30° to approximately 100° and preferably between 60° and 90° C. The atmosphere which is devoid of oxygen is maintained throughout the duration of the reaction, for example by maintaining a nitrogen flow throughout the reaction.

One water-soluble or water-dispersible copolymer I herein is the following:

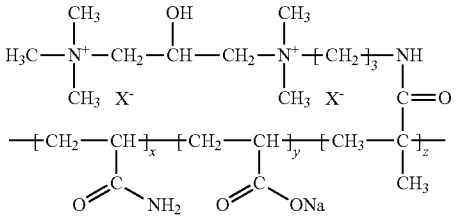

with x having a mean value of 0 to 50 mol %, preferably of 0 to 30 mol %, y having a mean value of 10 to 95 mol %, preferably of 20 to 80 mol %, z having a mean value of 3 to 80 mol %, preferably of 10 to 70 mol % and the y/z ratio preferably being of the order of 4/1 to 1/2, with x+y+z=100%, x, y and z representing the mol % of units derived from acrylamide, acrylic acid (sodium salt) and from Diquat respectively.

Another water-soluble or water-dispersible copolymer I herein chemical structures are as follows:

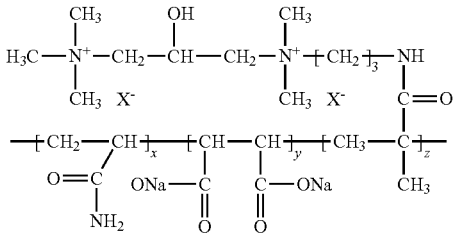

with x having a mean value of 0 to 50 mol %, alternatively of 0 to 30 mol %, y having a mean value of 10 to 95 mol %, alternatively of 20 to 80 mol %; z having a mean value of 3 to 80 mol %, alternatively of 10 to 70 mol % and the y:z ratio alternatively being of the order of 4:1 to 1:2;

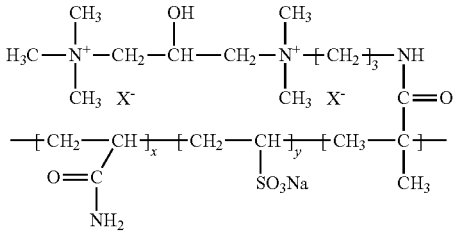

wherein x has a mean value of 0 to 50 mol %, preferably of 0 to 30 mol %, y has a mean value of 10 to 95 mol %, preferably of 20 to 80 mol %; z has a mean value of 3 to 80 mol %, preferably of 10 to 70 mol %, and the y:z ratio preferably being of the order of 4:1 to 1:2;

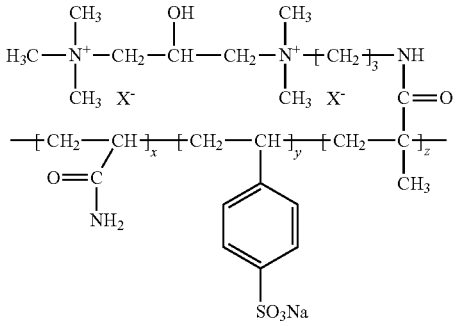

with x has a mean value of 0 to 50%, alternatively of 0 to 30 mol %, y has a mean value of 10 to 95 mol %, alternatively of 20 to 80 mol %, z has a mean value of 3 to 80 mol %, alternatively of 10 to 70 mol %, and the y:z ratio alternatively being of the order of 4:1 to 1:2;

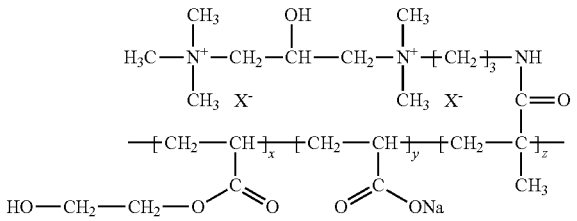

wherein x having a mean value of 0 to 50 mol %, alternatively of 0 to 30 mol %, y has a mean value of 10 to 95 mol %, alternatively of 20 to 80 mol %, z has a mean value of 3 to 80 mol %, alternatively of 10 to 70 mol %, and the y:z ratio alternatively being of the order of 4:1 to 1:2;

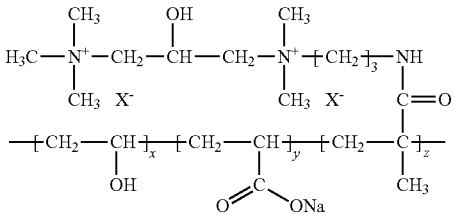

wherein x has a mean value of 0 to 50 mol %, alternatively of 0 to 30 mol %, y has a mean value of 10 to 95 mol %, alternatively of 20 to 80 mol %, z has a mean value of 3 to 80 mol %, alternatively of 10 to 70 mol %, and the y:z ratio alternatively being of the order of 4:1 to 1:2; or

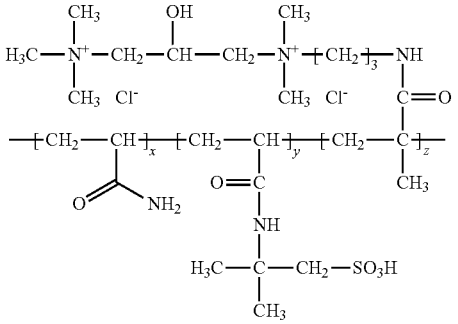

wherein x has a mean value of 0 to 50 mol %, alternatively of 0 to 30 mol %, y has a mean value of 10 to 95 mol %, alternatively of 20 to 80 mol %, z has a mean value of 3 to 80 mol %, alternatively of 10 to 70 mol %, and the y:z ratio alternatively being of the order of 4:1 to 1:2.

The water-soluble or water-dispersible copolymer II of the present invention comprises, in the form of polymerized units:

d) at least a monomer compound of general formula ii:

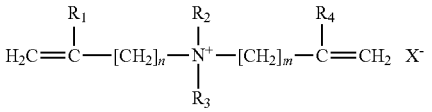

(ii)

in which: R1 and R4 independently represent H or a C1-6 linear or branched alkyl group; R2 and R3 independently represent a linear or branched C1-6 alkyl, hydroxyalkyl or aminoalkyl group, preferably a methyl group; n and m are integers of between 1 and 3; $X^-$ represents a counterion compatible with the water-soluble or water-dispersible nature of the polymer;

e) at least one hydrophilic monomer with an acid functionality that is copolymerisable with monomer d) and capable of ionizing in the medium in which it is used; and f) optionally an ethylenically unsaturated hydrophilic monomer compound of neutral charge bearing one or several hydrophilic groups which is copolymerisable with monomers d) and e); the monomer d) to monomer e) ratio ranging from between 60:40 and 5:95.

Alternatively, $R_1$ represents hydrogen, $R_2$ represents methyl, $R_3$ represents methyl, $R_4$ represents hydrogen, and m and n are equal to 1. The ion $X^-$ is preferably chosen from halogen, sulfate, hydrogen sulfate, phosphate, citrate, formate and acetate.

The monomer (e) and optionally the monomer (f) give the copolymer II hydrophilic properties. The copolymer II according to the invention advantageously has a molecular mass of at least 1000, advantageously of at least 10,000; it can be up to 20,000,000, advantageously up to 10,000,000. Except where otherwise indicated, when a molecular mass is mentioned, this will be the weight-average molecular mass, expressed in g/mol. This can be determined by aqueous gel permeation chromatography (GPC) or by measuring the intrinsic viscosity in a 1N $NaNO_3$ solution at 30° C. The copolymer II is preferably a random copolymer.

The monomer (d) alternatively has the following structure:

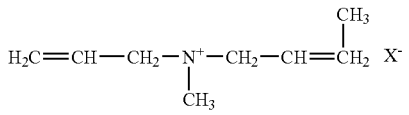

wherein $X^-$ is defined above. One monomer (d) is that of the above formula in which $X^-$ represents $Cl^-$, this monomer being known as diallyl dimethyl ammonium chloride (DADMAC).

The monomers (e) are those selected from the group consisting of water-soluble $C_3$-$C_8$ carboxylic, sulfonic, sulfuric, phosphonic or phosphoric acids containing monoethylenic unsaturation, anhydrides thereof and water-soluble salts thereof. Among the monomers (e) are those selected from the group consisting of acrylic acid, methacrylic acid, α-ethacrylic acid, β,β-dimethacrylic acid, methylenemalonic acid, vinylacetic acid, allylacetic acid, ethylideneacetic acid, propylideneacetic acid, crotonic acid, maleic acid, fumaric acid, itaconic acid, citraconic acid, mesaconic acid, N-methacryloylalanine, N-acryloylhydroxyglycine, sulfopropyl acrylate, sulfoethyl acrylate, sulfoethyl methacrylate, sulfoethyl methacrylate, styrenesulfonic acid, vinylsulfonic acid, vinylphosphonic acid, phosphoethyl acrylate, phosphonoethyl acrylate, phosphopropyl acrylate, phosphonopropyl acrylate, phosphoethyl methacrylate, phosphonoethyl methacrylate, phosphopropyl methacrylate and phosphonopropyl methacrylate, and the ammonium and alkali metal salts of these acids and mixtures thereof.

Among the monomers (f) are those selected from the group consisting of acrylamide, vinyl alcohol, $C_1$-$C_4$ alkyl esters of acrylic acid and of methacrylic acid, $C_1$-$C_4$ hydroxyalkyl esters of acrylic acid and of methacrylic acid, in particular ethylene glycol and propylene glycol acrylate and methacrylate, polyalkoxylated esters of acrylic acid and of methacrylic acid, in particular the polyethylene glycol and polypropylene glycol esters.

The monomer (d) content is between 5 mol % and 60 mol %, alternatively 20 mol 0% to 50 mol %. The monomer (e) content is between 10 mol % and 95 mol %, alternatively 20 mol % to 80 mol %. The monomer (f) content is between 0 mol % and 50 mol %, alternatively 5 mol % to 30 mol %. The d:e molar ratio is alternatively between 50:50 and 10:90.

The copolymers II of the invention can be obtained according to the known techniques for preparing copolymers, in particular by radical-mediated polymerization of the ethylenically unsaturated starting monomers which are known compounds or which can readily be obtained by a person skilled in the art using conventional synthetic processes of organic chemistry. Water-soluble or water-dispersible copolymer II is preferably obtained by the copolymerization of monomers containing a quaternary ammonium function and two groups containing ethylenic unsaturation with monomers containing a group capable of ionizing in the application medium to form anionic units, with a ratio of the first monomers to the second monomers which is within a given range. The radical-mediated polymerization is described in detail earlier with respect to agglomerating copolymer I.

In one embodiment, one copolymer II according to the present invention is (available from Rhodia):

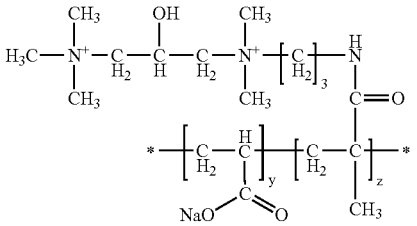

The following copolymers II may be used: DADMAC/acrylic acid/acrylamide copolymer; DADMAC/maleic acid copolymer; DADMAC/sulfonic acid copolymer; the DADMAC/acidic monomer molar ratio being between 60:40 and 5:95, preferably between 50:50 and 10:90. DADMAC stands for diallyl dimethyl ammonium chloride. One copolymer II is available from Rhodia; an alternative is available from Reckitt-Benckiser under the tradename Merquat 280. Another copolymer II is

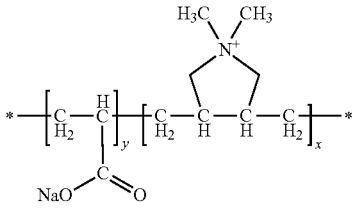

It has been found that the presence of the specific water-soluble or water-dispersible copolymer I or II herein in a liquid composition used to clean a hard surface allows to provide improved filming and/or streaking performance as well as improved shine performance as compared to the use in the same hard surface cleaning application of a composition that are free of the specific water-soluble or water-dispersible copolymer herein. Furthermore, it has been found that the presence of the specific copolymer herein in a liquid composition allows to provide improved soil repellency properties to the hard surface after an initial cleaning operation with the compositions according to the present invention. Moreover, it has been found that the presence of the specific copolymer herein in a liquid composition allows to provide improved next time cleaning benefit properties to the hard surface after an initial cleaning operation with the compositions of the present invention.

Chelating Agent

The compositions of the present invention may comprise a chelating agent. Indeed, it has been surprisingly found that addition of a chelating agent in the composition of the present invention provides an unexpected improvement in terms of removal of greasy soap scum.

Chelating agents can be incorporated in the compositions herein in amounts ranging from 0.01% to 10% by weight of the total composition, preferably from 0.01% to 5%, alternatively from 0.05% to 3%.

Suitable phosphonate chelating agents to be used herein may include alkali metal ethane 1-hydroxy diphosphonates (HEDP), alkylene poly(alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. One phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®. Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene. A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories. Suitable amino carboxylates to be used herein include ethylene diamine tetra acetates, diethylene triamine pentaacetates, diethylene triamine pentaacetate (DTPA), N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA). Further carboxylate chelating agents to be used herein include salicylic acid, aspartic acid, glutamic acid, glycine, malonic acid or mixtures thereof.

Solvent

The compositions of the present invention may further comprises a glycol ether solvent or a mixture thereof. Typically, the compositions of the present invention comprise from 0.1% to 5% by weight of the total composition of a glycol ether solvent or mixtures thereof, alternatively from 0.5% to 5% by weight of the total composition and alternatively from 1% to 3% by weight of the total composition.

Suitable glycol ether solvents for use herein include glycols having at least an ether function. It includes ethers and diethers having from 4 to 14 carbon atoms, alternatively from 6 to 12 carbon atoms, and alternatively from 8 to 10 carbon atoms, glycols or alkoxylated glycols, C6-C16 glycol ethers and mixtures thereof. All glycol disclosed herein will have to contain at least an ether function.

Suitable glycols ether to be used herein are according to the formula R—O-(A)n—R1-OH wherein R is a alkyl of from 1 to 20 carbon atoms, preferably from 2 to 15 and alternatively from 2 to 10, wherein R1 is H or a linear saturated or unsaturated alkyl of from 1 to 20 carbon atoms, alternatively from 2 to 15 and alternatively from 2 to 10, and A is an alkoxy group alternatively ethoxy, methoxy, and/or propoxy and n is from 1 to 5, preferably 1 to 2. Suitable glycol ether are, for example, propylene/ethylene glycol ethyl/methyl ether; di- or tri-propylene/ethylene glycol ethyl/methyl ether, propylene/ethylene or di- or tri-propylene/ethylene glycol methyl ether acetate, propylene/ethylene phenol ethyl/methyl/butyl ether or mixture thereof. Other suitable solvents include butyl diglycol ether (BDGE), butyltriglycol ether, ter amilic alcohol and the like. Solvents to be used herein may be butoxy propoxy propanol, butyl diglycol ether, butoxypropanol and mixtures thereof. The solvent for use herein may be butoxy propoxy propanol (n-BPP).

Anionic Surfactants

A further feature of the present invention is that the composition described herein is free of anionic surfactants. Indeed, this requirement is necessary as the anionic surfactants, due to their negative charge, form a complex with the cationic polymer described above. Compositions comprising cationic polymers and anionic surfactants do not provide therefore the benefit such as disclosed herein. The anionic surfactants refers to all those commonly known by those skilled person in the art, such as for example, alkyl sulphonates, alkyl aryl sulphonates, alkyl sulphates, alkyl alkoxylated sulphates, C6-C20 alkyl alkoxylated linear or branched diphenyl oxide disulphonates, or mixtures thereof.

Optional Ingredients

The liquid compositions according to the present invention may comprise a variety of optional ingredients depending on the technical benefit aimed for and the surface treated. Suitable optional ingredients for use herein include radical scavengers, perfumes, other solvents, builders, buffers, bactericides, hydrotropes, stabilizers, bleaches, bleach activators, suds controlling agents like fatty acids, silicone polymer, enzymes, soil suspenders, brighteners, anti-dusting agents, dispersants, pigments and dyes.

Dye

The liquid compositions according to the present invention may be coloured. Accordingly, they may comprise a dye or a mixture thereof. Suitable dyes for use herein are acid-stable dyes. By "acid-stable", it is meant herein a compound which is chemically and physically stable in the acidic environment of the compositions herein.

Caustic

In order to maintain the pH of the composition herein disclosed, the composition may further comprise a caustic or a mixture thereof, as an optional ingredient. Caustic to be used herein include all those known to the skilled in the art of hard-surfaces cleaner compositions, as hydroxides of metals, ammonia, and the like. One caustic is NaOH.

Radical Scavenger

The compositions of the present invention may comprise a radical scavenger or a mixture thereof. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®. Radical scavengers when used, are typically present herein in amounts up to 10% by weight of the total composition and preferably from 0.001% to 0.5% by weight. The presence of radical scavengers may contribute to the chemical stability of the acidic compositions of the present invention.

Silicone Polymer

The liquid composition according to the present invention may further comprise a silicone polymer as an optional but highly preferred ingredient.

Indeed it has been found that the composition of the present invention, when containing Silicone polymer, have a better clinging performance when applied to hard surface. Therefore, it provide a composition that adheres for a prolonged period of time on the hard surface applied thereon, especially when applied in the form of a spray. Therefore, an advantage of the present invention is to provide a spray-type hard surface cleaning composition that clings well to the surface applied.

Silicon polymers are preferred optional ingredients herein as they deposit onto the surfaces cleaned with a composition according to the present invention. Thereby, soil adherence, limescale and/or mineral encrustation build-up, is prevented. Indeed, it has been found, that the optional silicone polymers herein, deposit onto the hard surface, which is thereby rendered less prone the adherence and/or the build-up of limescale and mineral encrustation, etc. ("mineral deposition").

The composition herein may comprise up to 50%, alternatively from 0.01% to 30%, even more alternatively from 0.01% to 20%, and alternatively from 0.01% to 10%, by weight of the total composition of said silicone polymer.

Suitable silicone polymers are selected from the group consisting of silicone glycol polymers and mixtures thereof. In a preferred embodiment according to the present invention, the silicone polymer herein is a silicone glycol polymer. Depending on the relative position of the silicone-polyether chains, the silicone glycol polymer can be either linear or grafted.

Said silicone glycol polymer is according to the following formulae:

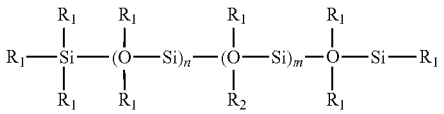

Grafted structure

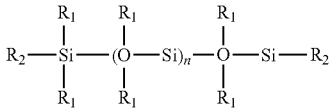

Linear structure wherein: each $R_1$ independently is H or a hydrocarbon radical; $R_2$ is a group bearing a polyether functional group; n is an integer of from 0 to 500; and for the grafted structure m is an integer of from 1 to 300, and alternatively with n+m more than 1. One embodiment herein the silicone polymer herein is a grafted silicone glycol. Alternatively, each $R_1$ independently is H or a hydrocarbon chain comprising from 1 to 16, alternatively a hydrocarbon chain comprising from 1 to 12 carbon atoms, and even alternatively $R_1$ is a $CH_3$-group. $R_1$ can also contain $NH_2$ groups and/or quaternary ammoniums. Alternatively n is an integer of from 0 to 100, more preferably an integer of from 1 to 100, alternatively n is an integer of from 1 to 50, and alternatively n is an integer of from 5 to 30. Preferably, m (for the grafted structure) is an integer of from 1 to 80, alternatively m is an integer of from 1 to 30, and alternatively m is an integer of from 2 to 10. Alternatively, n+m is more than 2. Preferably, $R_2$ is an alkoxylated hydrocarbon chain. Alternatively, $R_2$ is according to the general formulae:

$$—R_3\text{-}(A)_p\text{-}R_4 \text{ or } \text{-}(A)_p\text{-}R_4$$

wherein: $R_3$ is a hydrocarbon chain; A is an alkoxy group or a mixture thereof; p is an integer of from 1 to 50; and $R_4$ is H or a hydrocarbon chain, or —COOH.

Alternatively, $R_3$ may be a hydrocarbon chain comprising from 1 to 12, alternatively 3 to 10, even alternatively from 3 to 6, and most preferably 3 carbon atoms.

A may be an ethoxy or propoxy or butoxy unit or a mixture thereof, alternatively A is an ethoxy group. Alternatively, p is an integer of from 1 to 50, alternatively p is an integer of from 1 to 30, and even more preferably p is an integer of from 5 to 20. Preferably, R4 is H or a hydrocarbon chain comprising from 1 to 12, alternatively 1 to 6, alternatively from 3 to 6, and still even preferably 3 carbon atoms, alternatively R4 is H. Alternatively, the silicone glycol polymers suitable herein have an average molecular weight of from 500 to 100,000, alternatively from 600 to 50,000, alternatively from 1000 to 40,000, and most preferably from 2,000 to 20,000. Suitable, silicone glycol polymers are commercially available from General electric, Dow Corning, and Witco (see Applicant's co-pending European Patent Applications 03 447 099.7 and 03 447 098.9 for an extensive list of trade names of silicone glycol polymers). In one embodiment according to the present invention, the polymer herein is a Silicones-Polyethers copolymer, commercially available under the trade name SF 1288® from GE Bayer Silicones.

Bleach

The compositions according to the present invention may comprise, as an optional ingredient, bleach. Said bleach may be selected from the group consisting of sources of active oxygen, hypohalite bleaches and mixtures thereof.

The bleach, which can be the source of active oxygen according to the present invention acts as an oxidising agent, it increases the ability of the compositions to remove colored stains and organic stains in general, to destroy malodorous molecules and to kill germs. In one embodiment according to the present invention said bleach is a source of active oxygen or a mixture thereof.

Suitable sources of active oxygen for use herein are water-soluble sources of hydrogen peroxide including persulfate, dipersulphate, persulfuric acid, percarbonates, metal peroxides, perborates, persilicate salts, and mixtures thereof, as well as hydrogen peroxide, and mixtures thereof. As used herein a hydrogen peroxide source refers to any compound that produces hydrogen peroxide when said compound is in contact with water. In addition, other classes of peroxides can be used as an alternative to hydrogen peroxide and sources thereof or in combination with hydrogen peroxide and sources thereof. Suitable classes include dialkylperoxides, diacylperoxides, preformed percarboxylic acids, organic and inorganic peroxides and/or hydroperoxides. Suitable organic or inorganic peracids for use herein are selected from the group consisting of: persulphates such as monopersulfate; peroxyacids such as diperoxydodecandioic acid (DPDA) and phthaloyl amino peroxycaproic acid (PAP); magnesium perphthalic acid; perlauric acid; perbenzoic and alkylperbenzoic acids; and mixtures thereof. Suitable hydroperoxides for use herein are selected from the group consisting of tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide and mixtures thereof. Such hydroperoxides have the advantage to be particularly safe to carpets and carpet dyes while delivering excellent bleaching performance. Persulfate salts, or mixtures thereof, are the preferred sources of active oxygen to be used in the compositions according to the present invention. One persulfate salt to be used herein is the monopersulfate triple salt. One example of monopersulfate salt commercially available is potassium monopersulfate commercialized by Peroxide Chemie GMBH under the trade name Curox®. Other persulfate salts such as dipersulphate salts commercially available from Peroxide Chemie GMBH can be used in the compositions according to the present invention. The compositions according to the present invention may comprise from 0.1% to 30%, alternatively from 0.1% to 20%, alternatively from 1% to 10%, and alternatively from 1% to 7% by weight of the total composition of said bleach.

Perfume

Suitable perfumes for use herein include materials which may provide an olfactory aesthetic benefit and/or cover any "chemical" odour that the product may have. The main function of a small fraction of the highly volatile, low boiling (having low boiling points), perfume components in these perfumes is to improve the fragrance odour of the product itself, rather than impacting on the subsequent odour of the surface being cleaned. However, some of the less volatile, high boiling perfume ingredients provide a fresh and clean impression to the surfaces, and it is desirable that these ingredients be deposited and present on the dry surface. Perfume ingredients can be readily solubilized in the compositions, for instance by the anionic detergent surfactants. The perfume ingredients and compositions suitable to be used herein are the conventional ones known in the art. Selection of any perfume component, or amount of perfume, is based solely on aesthetic considerations. Suitable perfume compounds and compositions can be found in the art including U.S. Pat. Nos. 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. In general, the degree of substantivity of a perfume is roughly proportional to the percentages of substantive perfume material used. Relatively substantive perfumes contain at least about 1%, alternatively at least about 10%, substantive perfume materials. Substantive perfume materials are those odorous compounds that deposit on surfaces via the cleaning process and are detectable by people with normal olfactory acuity. Such materials typically have vapour pressures lower than that of the average perfume material. Also, they typically have molecular weights of about 200 and above, and are detectable at levels below those of the average perfume material. Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, ciscitral (neral), citronellal, citronellol, citronellyl acetate, para-cymene, decanal, dihydrolinalool, dihydromyrcenol, dimethyl phenyl carbinol, eucaliptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, mycrene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, and veratraldehyde. Cedarwood terpenes are composed mainly of alpha-cedrene, beta-cedrene, and other C15H24 sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8-hexamethyl-cyclopenta-gama-2-benzopyran), hexyl cinnamic aldehyde, lyral (4-(4-hydroxy-4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate. Selection of any particular perfume ingredient is primarily dictated by aesthetic considerations. The compositions herein may comprise a perfume ingredient, or mixtures thereof, in amounts up to 5.0% by weight of the total composition, alternatively in amounts of 0.1% to 1.5%.

Packaging Form of the Compositions

The compositions described herein may be packaged in a variety of suitable detergent packaging known to those skilled in the art. The liquid compositions can be packaged in conventional detergent plastic bottles.

The liquid compositions of the present invention may be packaged in a spray dispenser, preferably in a trigger spray dispenser or pump spray dispenser. In one preferred embodiment the compositions herein may be packaged in manually or electrically operated spray dispensing containers, which are usually made of synthetic organic polymeric plastic materials.

Indeed, said spray-type dispensers allow to uniformly apply to a relatively large area of a surface to be cleaned the liquid cleaning compositions suitable for use according to the present invention. Such spray-type dispensers are particularly suitable to clean vertical surfaces. Suitable spray-type dispensers to be used according to the present invention include manually operated foam trigger-type dispensers sold for example by Specialty Packaging Products, Inc. or Continental Sprayers, Inc. These types of dispensers are disclosed, for instance, in U.S. Pat. No. 4,701,311 to Dunnining et al. and U.S. Pat. No. 4,646,973 and U.S. Pat. No. 4,538,745 both to Focarracci. Particularly preferred to be used herein are spray-type dispensers such as T 8500® commercially available from Continental Spray International or T 8100® commercially available from Canyon, Northern Ireland. In such a dispenser the liquid composition is divided in fine liquid droplets resulting in a spray that is directed onto the surface to be treated. Indeed, in such a spray-type dispenser the composition contained in the body of said dispenser is directed through the spray-type dispenser head via energy communicated to a pumping mechanism by the user as said user activates said pumping mechanism. More particularly, in said spray-type dispenser head the composition is forced against an obstacle, e.g., a grid or a cone or the like, thereby providing shocks to help atomise the liquid composition, i.e., to help the formation of liquid droplets.

The Process of Treating a Hard-Surface:

The present invention encompasses a process of cleaning a hard surface with a liquid composition as described herein. In particular, the present invention relates to a method of removing soap scum from a hard-surface comprising the step of applying the composition of the present invention onto the hard-surface.

By "treating" it is meant herein, cleaning, as the composition according to the present invention provides excellent first-time and next-time cleaning performance on various stains, especially greasy soup scum.

By "hard surface", it is meant herein any kind of surface typically found in houses like kitchens, bathrooms, e.g., floors, walls, tiles, windows, cupboards, sinks, showers, shower plastified curtains, wash basins, WCs, dishes, fixtures and fittings and the like made of different materials like ceramic, vinyl, no-wax vinyl, linoleum, melamine, glass, Inox®, Formica®, any plastics, plastified wood, metal or any painted or varnished or sealed surface and the like. Hard-surfaces also include household appliances including, but not limited to refrigerators, freezers, washing machines, automatic dryers, ovens, microwave ovens, dishwashers and so on.

In one embodiment according to the present invention, the hard surfaces to be cleaned in the process herein are delicate hard surfaces. Delicate hard surfaces describe all the surfaces which can be damage according to the use of acidic composition for example. The hard surface to be cleaned in the process herein may be selected from the group consisting of plastic surfaces.

One method of removing soap scum from a hard-surface comprises the step of applying a liquid composition as described above onto said hard-surface, leaving said composition on said hard-surface to act, optionally wiping said hard-surface with an appropriate instrument, e.g. a sponge, and then preferably rinsing said hard-surface with water.

The compositions of the present invention may be contacted to the hard-surface to be treated in its neat form or in its diluted form. The composition may be applied in its neat form. By "rinsing", it is mean herein contacting the hard surface cleaned with the process according to the present invention with substantial quantities of appropriate solvent, typically water, directly after the step of applying the liquid composition herein onto said hard surface. By "substantial quantities", it is meant herein between 0.01 lt. and 1 lt. of water per m2 of hard surface, alternatively between 0.1 lt. and 1 lt. of water per m2 of hard surface. By "in its neat form", it is to be understood that the liquid compositions are applied directly onto the enamel surface to be treated without undergoing any dilution, i.e., the liquid compositions herein are applied onto the hard-surface as described herein. By "diluted form", it is meant herein that said composition is diluted by the user with an appropriate solvent, typically with water. The composition is diluted prior use to a typical dilution level of 10 to 400 times its weight of water, preferably from 10 to 200 and more preferably from 10 to 100. Usual recommended dilution level is a 1.2% dilution of the composition in water. Dilution may occur immediately prior to the application of the composition herein onto the hard surface to be cleaned, e.g., in an appropriate receptacle such as a bucket, wherein an effective amount of liquid composition herein is mixed with water. In a preferred embodiment, the process herein comprises the additional step of diluting said composition with an appropriate solvent, preferably with water, before applying said composition in diluted form onto said hard surface.

In the process herein, said composition is applied onto said surface by conventional means known by the skilled person. Indeed, the composition, may be applied by pouring or spraying said composition onto said surface. Alternatively, said composition may be applied using an appropriate implement, such as a mop or a cloth, soaked in the diluted composition herein. Furthermore, once applied onto said surface said composition may be agitated over said surface using an appropriate implement. Indeed, said surface may be wiped using a mop or a cloth. During such a cleaning operation parts of the composition herein may be captured in the cleaning implement, if any, (in combination with soil initially present on the surface) and transferred into a bucket or another suitable receptacle (squeezing of the mop or cloth), another part of the composition will be left on the surface after the cleaning operation. Indeed, the composition is, alternatively at least partially, left on said surface at the end of said process of cleaning said hard surface, alternatively left on said surface until the next cleaning operation and alternatively at least partially left on said surface until the next cleaning operation. In one embodiment, the composition will be applied by spraying said composition onto said surface. The method according to the present invention is suitable for treating hard-surfaces located in bathrooms or in kitchens, and particularly in bathrooms. The method of the present invention provides particularly improved cleaning performance on soap scum stains, and especially on greasy soap scum stains. In a further aspect, the present invention relates to the use, of the composition of the present invention for removing soap scum from a hard-surface and to improve the soap scum cleaning performance of the composition.

The invention is further illustrated by the following examples. The following examples are meant to exemplify compositions used in process according to the present invention but are not necessarily used to limit or otherwise define the scope of the present invention.

Example 1

Compositions

The compositions are made by combining the listed ingredients in the listed proportions (weight % unless otherwise specified).

| | | A | B | C | D | E |
|---|---|---|---|---|---|---|
| Surfactant | Dobanol 91.8 | 3.0 | 1.5 | 6.0 | 3.0 | 2.0 |
| | Lutensol CS6250 | 1.2 | 2.0 | 1.0 | 1.5 | 2.0 |
| | C12-14AO | 2.0 | 3.0 | 4.0 | 3.0 | 0.5 |
| Solvent | n-BPP | 1.0 | 0.7 | 1.2 | 1.0 | 1.0 |
| Polymer | polymer a | 0.1 | 0.2 | 0.05 | 0.5 | 0.1 |
| | polymer b | — | 0.1 | — | — | 0.5 |
| Buffer | Citric acid | 3.0 | 4.0 | 3.0 | 2.0 | 3.0 |
| | Caustic acid | 0.3 | 0.4 | — | 0.2 | 0.3 |
| Chelant | DTPA | 0.1 | 0.2 | 0.2 | — | — |
| | HEDP | — | — | — | 0.1 | 0.3 |
| Rheology modifier | Acusol 882 | 0.9 | 1.2 | 1.5 | 0.5 | 0.9 |
| Water and minors | | | | Up to 100% | | |
| pH | | 3.5 | 3.5 | 3.5 | 3.5 | 3.5 |

| | | F | G | H | I | J |
|---|---|---|---|---|---|---|
| Surfactant | Dobanol 91.8 | 3.0 | 4.5 | 3.0 | 3.0 | 3.0 |
| | Lutensol CS6250 | 2.0 | 1.2 | 1.5 | 1.25 | 1.25 |
| | C12-14AO | 1.5 | 2.0 | 3.0 | 2 | 2 |

-continued

| | | | | | | |
|---|---|---|---|---|---|---|
| Solvent | n-BPP | 0.7 | 1.0 | 1.0 | 1.0 | 1.0 |
| Polymer | Copolymer a | 0.1 | 0.05 | 0.5 | 0.1 | — |
| | Copolymer b | — | — | — | — | — |
| Buffer | Citric acid | 3.0 | 2.0 | 4.0 | 3.0 | 3.0 |
| | Caustic acid | 1.8 | 1.2 | 2.5 | 1.8 | 1.8 |
| Chelant | DTPA | — | 0.1 | 0.5 | — | — |
| | $Na_2HEDP$ | 0.1 | — | — | 0.1 | 0.1 |
| Rheology modifier | Acusol 882 | 0.9 | 0.5 | 1.2 | 0.9 | 0.9 |
| Water and minors | | | | Up to 100% | | |
| pH | | 6.5 | 6.5 | 6.5 | 6.5 | 6.5 |

Dobanol ® 91-8 is a $C_9$—$C_{11}O_8$ ethoxylated alcohol commercially avilable from Shell.
Lutensol ® CS6250 is C6AO5 ethoxylated alcohol commercially available from BASF.
C12-14 AO is a C12-C14 dimethyl amine oxide surfactant.
n-BPP is butoxy propoxy propanol commercially available from Dow Chemical.
Citric acid is commercially available from ADM.
DTPA is Diethylene-triamyl-pentacetic acid penta-sodium salt.
$Na_2HEDP$ is Hydroxyethylene diphosphoric acid Sodium Salt.
Acusol 882 ® is a hydrophobically modified nonionic polyol (hydrophobically modified ethoxylated polyurethane) commercially available from Rohm and Haas.
Polymer b is a silicone polymer name (SF 1288 ®) available from GE Bayer Silicones.
Polymer a, available from Rodhia, is

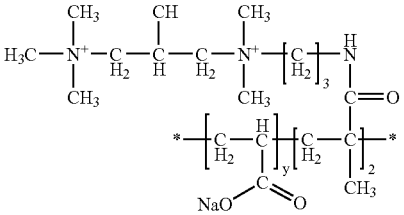

Example of compositions A to I are packed in a manually operated trigger sprayer (Guala TS-3 model) and sprayed onto hard surface. These compositions exhibit excellent greasy soap scum cleaning performance and are safe to delicate surface, especially plastic surface.

Example 2

Next Time Cleaning and Greasy Soap Scum Cleaning Performance Test

The Greasy soap scum cleaning performance and the next time cleaning performance of a composition are evaluated according to the following tests method A. Greasy Soap Scum Cleaning Performance Test Method:

Enamel white tiles (typically 24 cm×4 cm) are covered with typical greasy soap scum soils mainly based on calcium stearate and artificial body soils commercially available (e.g. 0.3 grams with a sprayer). The soiled tiles are then dried in an oven at a temperature of 140° C. for 10-45 minutes, preferably 40 and then aged between 2 and 12 hours at room temperature (around 20° C.-25° C.) on a controlled environment humidity (60-85%, preferably 75). Then the soiled tiles are cleaned using 5 ml of the composition of the present invention poured directly on a Spontex® (with or without soaking, preferably without soaking). The ability of the composition to remove greasy soap scum is measured through the number of stroke cycles needed to perfectly clean the surface. The lower the number of stroke cycles, the higher the greasy soap scum cleaning ability of the composition.

B. Next Time-Cleaning Benefit Test Method:

In this test method stainless enamel white tiles are treated with the liquid composition of the present invention by directly pouring said composition the surface to be treated, then the surface is rinsed. The above Greasy soap scum cleaning performance test method is then reapplied but the composition is spray onto the soiled tiles (instead of being poured directly on a sponge). The ability of a composition to provide next time-cleaning benefit performance to the surface refers to the composition's ability to modify the surface in such a way, that the soil is rinsed away more easily on surfaces treated with the liquid composition of the present invention compared to surfaces not treated with said composition.

The result of the Greasy soap scum cleaning performance for the first time cleaning and for the second time cleaning are expressed by reference to a standard global reference (100) reflecting the standard cleaning effect of common hard surface compositions. The test is performed using a product available on the market as reference. The data are obtained according to the above method using the composition of the present invention, with or without the presence of cationic polymer, at different pH. All the results are statistically significant.

The composition α is a standard acidic composition containing common anionic surfactant (1.8% Anionic surfactant (Isalchem AS); 0.9% nBPP; 2.7% Citric acid; 0.81% KOH; 0.025 silicone polymer; 0.01% proxel; 0.27 Xanthan gum).

| Product/ composition | Ref. | Water | Comp. α | Comp. α | Comp. J | Comp. I | Comp. A |
|---|---|---|---|---|---|---|---|
| Presence of the copolymer I | — | — | — | — | No | Yes | Yes |
| pH | | | 3.5 | 6.5 | 6.5 | 6.5 | 3.5 |
| 1st time (Cleaning Index) | 100 | / | 145 | 80 | / | 109-130 | 224 |
| Next time (Cleaning Index) | 100 | 142 | / | / | 170 | 331 | 460 |

The data clearly show that the Greasy soap scum cleaning performance is improved, on the first time cleaning but also on the next time cleaning, when using the composition of the present invention.

The cleaning index has also been evaluated used the using the composition I formula (with 3% Nonionic surfactant) and variation of level of the Amine Oxide (C12-14AO). All the results are statistically significant.

| | Comp. I with: | | | |
|---|---|---|---|---|
| | 0.5% Amine Oxide | 1% Amine Oxide | 1.5% Amine Oxide | 2% Amine Oxide |
| Cleaning Index: | 68 | 100 | 124 | 131 |

This data clearly show the relevance of the presence of Amine Oxide in the composition according to the present invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid composition having a pH between 3 and 7 consisting of:

a) non ionic surfactant or a mixture thereof, b) an amine oxide or a mixture thereof present in the amount of 0.05% to 3.0% by weight of the total composition, c) a glycol ether solvent, d) a chelant, said chelant is an alkali metal ethane 1-hydroxy diphosphonate, e) a cationic polymer having the following formula:

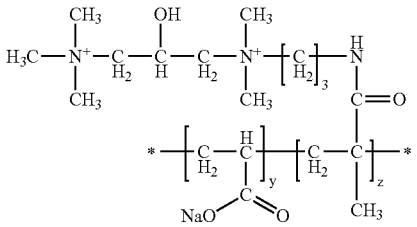

wherein the y:z ratio is 4:1 to 1:2;

f) an acid or a mixture thereof present in the amount of 0.5% to 10% by weight of the total composition;

g) a rheology modifier;

h) water present in the amount of 75% to 95% by weight of the total composition;

i) a perfume, and wherein the composition is adapted to clean a delicate hard surface, wherein the weight ratio between nonionic surfactant and amine oxide is 60:40.

2. The composition according to claim 1 wherein the acid or a mixture thereof is present in an amount from 2% to 6% by weight of the total composition.

3. The composition according to claim 2 wherein the acid is an organic acid selected from the group consisting of citric acid, maleic acid lactic acid, glycolic acid, succinic acid, glutaric acid and adipic acid, and mixtures thereof.

4. The composition according to claim 1 wherein the non-ionic surfactant is the product of condensation of ethylene oxide with an alcohol having a straight alkyl chain having from 6 to 22 carbon atoms and wherein the degree of ethoxylation is from 5 to 12 or mixtures thereof.

5. The composition according to claim 1 wherein the non-ionic surfactant is present in an amount from 1% to 5% by weight of the total composition.

6. The composition according to claim 1 wherein the non-ionic surfactant is present in an amount from 2% to 3% by weight of the total composition.

7. The composition according to claim 1 wherein the glycol ether solvent is butoxy propoxy propanol.

8. The composition according to claim 1 wherein said cationic polymer is present in an amount from 0.01% to 0.5% by weight of the total composition.

9. The composition according to claim 1 wherein said composition is packaged in a spray container.

10. A method of treating a hard-surface comprising the step of applying a liquid composition according to claim 1 onto said hard-surface.

11. The method of treating a hard-surface according to claim 10 wherein said hard-surface is a bathroom hard-surface.

12. The method of treating a hard-surface according to claim 10 wherein said hard-surface is a plastic or enamel surface.

13. The method of treating a hard-surface according to claim 10 wherein said hard surface is an inclined hard surface.

14. A method of removing greasy soap scum on hard surfaces comprising the step of providing the composition according to claim 1 to said hard surface.

15. A method of improving clinging foam on a treated hard surface comprising the step of providing the composition according to claim 1 on said hard surface.

16. The composition according to claim 1 wherein said delicate hard surface is plastic or enamel.

* * * * *